US008469109B2

(12) United States Patent
Wang et al.

(10) Patent No.: US 8,469,109 B2
(45) Date of Patent: Jun. 25, 2013

(54) DEFORMABLE DART AND METHOD

(75) Inventors: David Wei Wang, Sugar Land, TX (US); Gary L. Rytlewski, League City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 290 days.

(21) Appl. No.: 12/695,110

(22) Filed: Jan. 27, 2010

(65) Prior Publication Data

US 2011/0180274 A1 Jul. 28, 2011

(51) Int. Cl.
*E21B 33/128* (2006.01)

(52) U.S. Cl.
USPC ..... 166/386; 166/318; 166/194

(58) Field of Classification Search
USPC ..... 166/386, 383, 192, 193, 194, 195, 166/153, 154, 155, 318; 285/321
See application file for complete search history.

(56) References Cited

U.S. PATENT DOCUMENTS

| | | | | |
|---|---|---|---|---|
| 3,091,294 | A * | 5/1963 | Evans et al. | 166/135 |
| 4,442,894 | A * | 4/1984 | Callihan et al. | 166/156 |
| 4,850,622 | A * | 7/1989 | Suzuki | 285/288.1 |
| 5,022,687 | A * | 6/1991 | Ariga | 285/321 |
| 6,923,255 | B2 * | 8/2005 | Lee | 166/154 |
| 7,093,664 | B2 | 8/2006 | Todd et al. | |
| 7,168,494 | B2 | 1/2007 | Starr et al. | |
| 7,353,879 | B2 | 4/2008 | Todd et al. | |
| 2004/0118564 | A1 * | 6/2004 | Themig et al. | 166/305.1 |
| 2005/0167095 | A1 * | 8/2005 | Nguyen | 166/88.2 |
| 2006/0124310 | A1 * | 6/2006 | Lopez de Cardenas et al. | 166/313 |
| 2007/0044958 | A1 | 3/2007 | Rytlewski et al. | |
| 2007/0107908 | A1 | 5/2007 | Vaidya et al. | |
| 2010/0209288 | A1 | 8/2010 | Marya et al. | |
| 2010/0212911 | A1 | 8/2010 | Chen et al. | |
| 2010/0230114 | A1 * | 9/2010 | Jennings | 166/377 |
| 2010/0252280 | A1 * | 10/2010 | Swor et al. | 166/386 |

OTHER PUBLICATIONS

Schlumberger Oilfield Glossary entry for "wellhead", accessed Jul. 30, 2012 via www.glossary.oilfield.slb.com.*
Dictionary definition of "ring", accessed Jul. 30, 2012 via thefreedictionary.com.*

* cited by examiner

*Primary Examiner* — Jennifer H Gay
*Assistant Examiner* — Blake Michener

(57) ABSTRACT

An apparatus and method for plugging a wellbore completion. The apparatus includes a body and a variable diameter ring. The body includes a first portion having a first diameter, and a second portion having a second diameter that is smaller than the first diameter. The variable diameter ring is disposed around the body and slidable on the first and second portions. The ring is configured to engage a flow path reduction device when located on the first portion, and to move past the flow path reduction device when located on the second portion.

20 Claims, 3 Drawing Sheets

DEFORMABLE DART AND METHOD

BACKGROUND

In treat and produce ("TAP") completions, multiple valves are installed at different layers of a wellbore adjacent a formation or hydrocarbon reservoir. A downhole dart is pumped down the TAP completion, past a first valve, and engages a valve ring of a second valve, which is located at the bottom of the wellbore, or at least nearer thereto than the first valve. When the downhole dart engages the valve ring of the second valve, the valve ring and the downhole dart form a seal. The pressure within the TAP completion can be increased to shift the second valve open when the seal is formed between the downhole dart and the valve ring. Once the second valve is opened, the formation adjacent the second valve can be fractured. In addition, the pressure in the TAP completion can compress or squeeze the valve ring of the first valve. The valve ring of the first valve then has a smaller inner diameter and can catch an additional downhole dart pumped into the TAP completion. This process can be repeated until each valve of the TAP completion is actuated and the formation adjacent the valves is fractured.

After the formation is fractured, the downhole darts typically have to be removed. Removal of the downhole darts, however, is problematic, because the valve rings usually all have about the same inner diameter, and the downhole darts usually have a common outer diameter. Accordingly, every downhole dart, except for the last one sent into the completion, is trapped between two valve rings. The downhole darts thus usually have to be dissolved or drilled out to allow the completion to be reopened. Dissolving darts, however, can limit the range of wellbore types and wellbore fluids that may be used in conjunction therewith, while drilling out the darts can be expensive and time-consuming.

A need exists, therefore, for a downhole dart that can engage a downhole valve assembly and can be efficiently recovered.

SUMMARY

Embodiments of the disclosure provide an exemplary apparatus for plugging a wellbore completion, which includes a body and a variable diameter ring. The body includes a first portion having a first diameter, and a second portion having a second diameter that is smaller than the first diameter. The variable diameter ring is disposed around the body and is slidable on the first and second portions. The ring is configured to engage a flow path reduction device when located on the first portion, and to move past the flow path reduction device when located on the second portion.

Embodiments of the disclosure also provide an exemplary method for plugging a wellbore completion. The exemplary method includes deploying a dart into the wellbore completion past a first valve assembly, and catching the dart by engaging a ring disposed on the dart with a second valve assembly to plug the wellbore completion. The exemplary method also includes reducing a diameter of the first valve assembly from an initial diameter that is larger than a ring diameter of the ring, to a reduced diameter that is smaller than the ring diameter, and drawing the dart away from the second valve assembly and toward the first valve assembly. The exemplary method further includes engaging the ring with the first valve assembly having the reduced diameter, and moving the ring into a recessed section of the dart to reduce the ring diameter such that the ring diameter is less than the reduced diameter of the first valve assembly.

Embodiments of the disclosure further provide another exemplary apparatus for plugging a wellbore completion, which includes a body and a dart ring. The body includes a main section having a main diameter, a first recessed portion having a first recessed diameter that is less than the main diameter, and a second recessed portion having a second recessed diameter that is less than the first recessed diameter. The dart ring is disposed around the body, has an adjustable diameter, and is configured to slide between the first and second recessed portions such that an inner diameter of the dart ring conforms to the first recessed diameter when the ring is located on the first recessed portion and the inner diameter conforms to the second recessed diameter when the dart ring is located on the second recessed portion.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1:
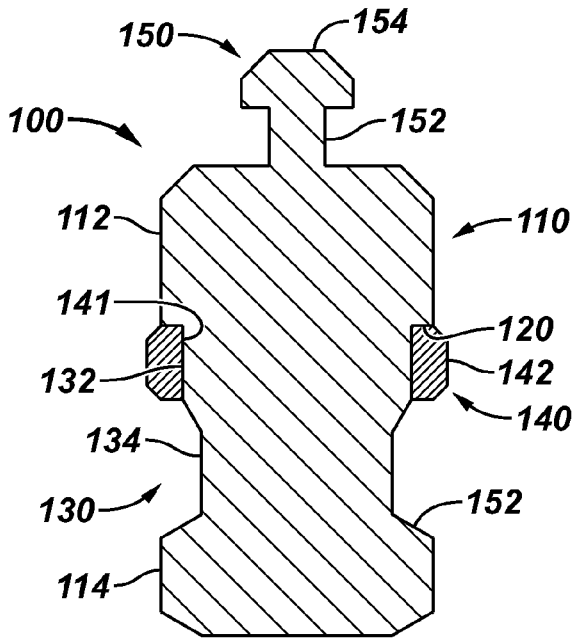
FIG. 1 depicts a cross-sectional view of an exemplary downhole dart, according to one or more embodiments described.

FIG. 1 depicts a cross-sectional view of a downhole dart 100, according to one or more embodiments. The downhole dart 100 can have a body 110, which can be generally circular in cross section. The downhole dart 100 can have with a main portion including a first body portion 112 and a second body portion 114, and a recessed section 130 disposed between the first and second body portions 112, 114. The first and second body portions 112, 114 can have enlarged diameters relative to the recessed section 130. Furthermore, the recessed section 130 can include a first recessed portion 132 of a first diameter and a second recessed portion 134 of a second diameter, with the second diameter being smaller than the first diameter, for example. In an exemplary embodiment, the first and second recessed sections 132, 134 can be located directly adjacent each other, such that no other body 110 elements are defined therebetween. An annular ring 140 can be disposed around the body 110, and located in the recessed section 130.

The body 110 can also include first and second stops 120, 125. The first stop 120 and the second stop 125 can be, for example, shoulders defined at the edges of the recessed section 130. As such, the first and second stops 120, 125 can contain the ring 140 in the recessed section 130. For example, the first stop 120 can be disposed between the first body section 112 and the first recessed portion 132, and the second stop 125 can be between the second body portion 114 and the second recessed portion 134.

Figure 5:
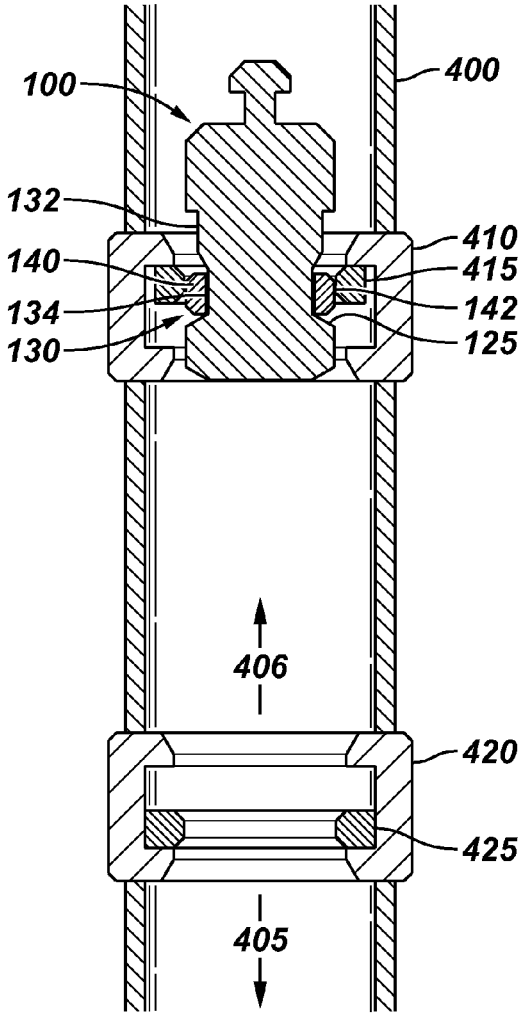
FIG. 5 depicts a cross-sectional view of the downhole dart depicted in FIG. 1 passing through the tubular member depicted in FIG. 4 in a second direction, according to one or more embodiments.

The ring 140 can be a c-ring or the like, and can have an adjustable or variable interior diameter 141 and outer diameter 142. The ring 140 can have a first diameter when disposed around the first recessed portion 132 and a second diameter when disposed around the second recessed portion 134 (FIG. 5). The ring 140 can initially be adjacent the first stop 120, and can be moveable, for example by sliding, to the second stop 125. The interior and outer diameters 141, 142 can decrease as the ring 140 travels from the first recessed portion 132 to the second recessed portion 134. Further, the interior and outer diameters 141, 142 of the ring 140 can increase as the ring 140 moves from the second recessed portion 134 to the first recessed portion 132.

In one or more embodiments, the downhole dart 100 can also have a fishing head 150 disposed on a portion of the body 110. The fishing head 150 can include a cap or top portion 154 and an elongated portion or stem 152. The cap portion 154 can be configured to latch to or otherwise secure to one or more service tools (not shown), to facilitate retrieval of the downhole dart 100.

Figure 2:
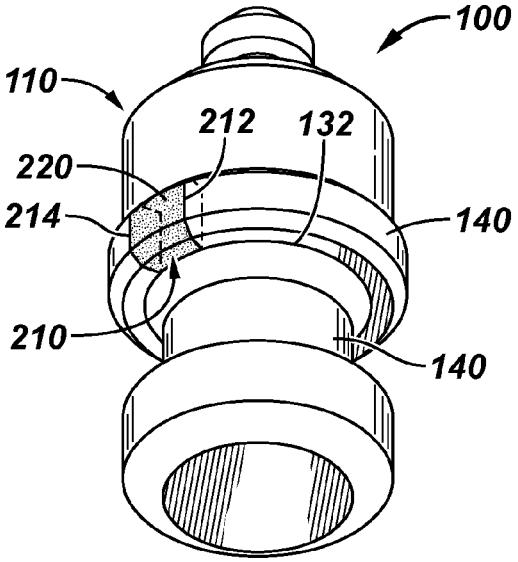
FIG. 2 depicts a perspective view of an exemplary ring disposed around the downhole dart depicted in FIG. 1, according to one or more embodiments described.

FIG. 2 depicts a perspective view of the annular ring 140 disposed around the body 110 of the downhole dart 100, according to one or more embodiments. The ring 140 can have two ends 212, 214 separated by a gap 210. The ends 212, 214 can move apart or closer together, causing the gap 210 to expand or contract, for example, as the ring 140 slides between the first and second recessed sections 132, 134. This can give the ring 140 the variable diameter, such that the inner diameter 141 (FIG. 1) of the ring 140 can conform to the diameter of the body 110 as it slides between the first and second recessed sections 132, 134. A rib 220 can be disposed between the ends 212, 214, and can be or include a deformable elastic material connected to the ends 212, 214 of the gap 210. Accordingly, as the gap 210 expands or contracts, the rib 220 can compliantly deform to fill the gap 210.

Figure 3:
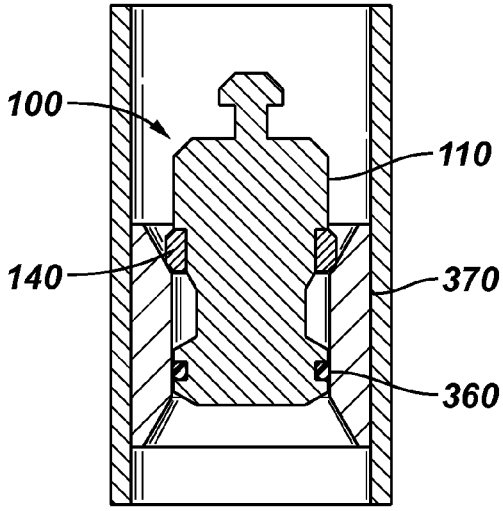
FIG. 3 depicts a cross-sectional view of an illustrative seal member disposed around a portion of the downhole dart depicted in FIG. 1, which is engaged with a downhole valve assembly, according to one or more embodiments described.

FIG. 3 depicts a cross-sectional view of the downhole dart 100 with a seal member 360 disposed around a portion of the body 110, according to one or more embodiments. The seal member 360 can be engaged with an exemplary downhole valve assembly 370. As shown, the ring 140 can engage the downhole valve assembly 370, such that the sealing member 360 creates a sealing engagement between the body 110 and the downhole valve assembly 370.

Figure 4:
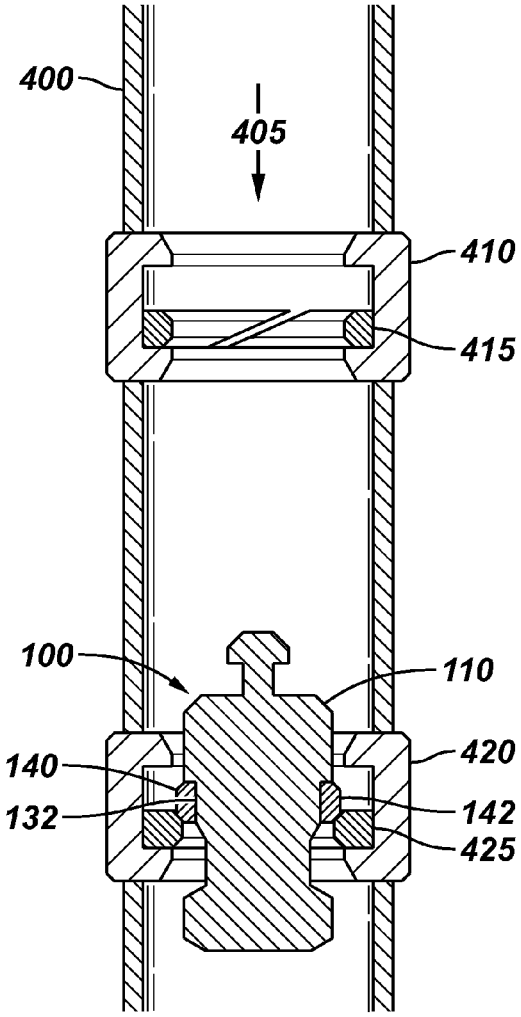
FIG. 4 depicts a cross-sectional view of the downhole dart depicted in FIG. 1 passing through a downhole tubular member in a first direction, according to one or more embodiments described.

FIG. 4 depicts a cross-sectional view of an exemplary embodiment of the downhole dart 100 passing into a portion of a downhole tubular member 400 in a first direction, indicated by arrow 405. The tubular member 400 can include first and second valve assemblies 410, 420. The first and second valve assemblies 410, 420 can include first and second flow path reduction devices 415, 425, respectively, which can also be referred to herein as first and second collars or valve rings 415, 425. In an exemplary embodiment, the second flow path reduction device 425 can have an internal diameter that is smaller than the outer diameter 142 of the ring 140 of the downhole dart 100, when the ring 140 is located in the larger-diameter first recessed region 132. The first flow path reduction device 415 can initially have an internal diameter that is larger than the outer diameter 142 of the ring 140, even when the ring 140 is located in the larger-diameter first recessed portion 132. In this configuration, the downhole dart 100 can be deployed into the tubular member 400 and can pass by the first flow path reduction device 415, but can be caught by the second flow path reduction device 425, as shown.

The first flow path reduction device 415 can be deformable in response to pressure to reduce the inner diameter thereof, such that, when deformed, the first flow path reduction device 415 can have a reduced interior diameter. The first flow path reduction device 415 with the reduced diameter can catch a subsequently deployed downhole dart 100 having its ring 140 on the first recessed portion 132. If the second flow path reduction device 425 is the distal-most flow path reduction device in the tubular member 400, it can be deformable in some exemplary embodiments, but may not be deformable in others. However, if the second flow path reduction device 425 is not the distal-most, it can deform similarly to the first flow path reduction device 415.

FIG. 5 depicts a cross-sectional view of the downhole dart 100 passing back through the tubular member 400 in a second direction, indicated by arrow 406, opposite the first direction 405, for example, during retrieval of the downhole dart 100. The downhole dart 100 can be urged or drawn in the second direction 406 toward the first flow path reduction device 415 by fluidic pressure. The ring 140 can remain located in the first recessed portion 132 as the downhole dart 100 disengages from the second downhole valve assembly 420. The ring 140 can subsequently engage the first flow path reduction device 415, and the first flow reduction device 415 can apply a force on the ring 140 in the first direction 405 as the fluidic pressure in the second direction 406 urges the downhole dart 100 in the second direction 406. Accordingly, the ring 140 can slide in the recessed section 130, from the larger-diameter first recessed portion 132, to the smaller-diameter second recessed portion 134. The ring 140 can reduce in diameter, for example, decreasing the outer diameter 142, as described above with reference to FIGS. 1 and 2, and can disengage from the first flow restriction device 415. The ring 140 can engage the second stop 125, and the downhole dart 100 can pass through the first flow path reduction device 415 and can be retrieved from a wellbore or completion assembly.

Figure 6:
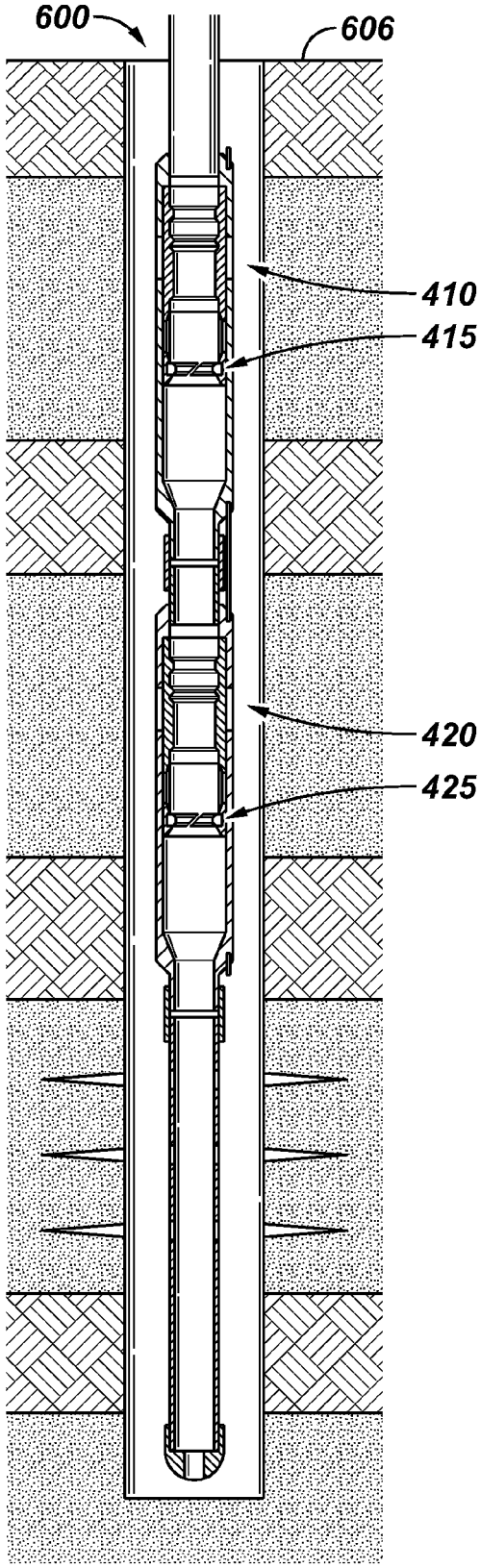
FIG. 6 depicts a schematic view of an illustrative downhole completion, according to one or more embodiments described.

FIG. 6 depicts a schematic view of an exemplary downhole completion 600, which can be a TAP completion or any other completion. Additional downhole completion equipment can be included with the downhole completion 600, as is known in the art. Downhole darts, such as those described above and given reference numeral 100, can be deployed into the downhole completion 600 to facilitate actuation of first and second valve assemblies 410, 420. For example, a first downhole dart can be deployed, and can catch on the second flow path reduction device 425. The second valve assembly 420 can be located between the surface 606 and the second flow path reduction device 425. The second valve assembly 420 can be opened, and high-pressure fluids, for example, can be pumped into the wellbore completion 600 and out the second valve assembly 420, as the downhole dart can keep the fluid from progressing farther into the wellbore completion 600. Pressure associated with the processing, or otherwise applied into the wellbore completion 600, can squeeze the first flow path restriction device 415, causing the interior diameter thereof to decrease. A second downhole dart can then be deployed down the wellbore completion 600, and can catch on the first flow path reduction device 415, thereby isolating the first valve assembly 410 from the second valve assembly 420. The first valve assembly 420 can then be opened allowing fluids, for example under high pressure, to be applied out through the open the first valve assembly 415. Once processing is complete, a flow of fluid in the opposite direction, for example, during production, can propel the downhole darts back to the surface, as described above. It will be appreciated that the sequence of catching downhole darts and providing for their retrieval can be repeated for as many valve assemblies and/or flow path restriction devices as desired.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

As used herein, the terms "up" and "down;" "upper" and "lower;" "upwardly" and "downwardly;" "upstream" and "downstream;" and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. An apparatus for plugging a wellbore completion, comprising:

a dart comprising a first portion having a first outer diameter; and a second portion having a second outer diameter, wherein the second outer diameter is less than the first outer diameter;

a ring disposed around the dart and slidable on the first and second portions of the dart, wherein the ring has an inner diameter that is variable between a first inner diameter when the ring is disposed around the first portion of the dart and a second inner diameter when the ring is disposed around the second portion of the dart; and a valve assembly having an inner diameter that is variable between a first inner diameter and a second inner diameter, wherein an outer diameter of the ring is less than the first inner diameter of the valve assembly when the ring is disposed around the first portion of the dart such that the dart is able to pass through the valve assembly, and wherein the outer diameter of the ring is greater than the second inner diameter of the valve assembly when the ring is disposed around the first portion of the dart such that the ring is configured to engage the valve assembly.

2. The apparatus of claim 1, wherein the dart further comprises a main section having a main diameter that is larger than the first outer diameter of the dart.

3. The apparatus of claim 2, wherein the first and second portions are recesses defined in the main section.

4. The apparatus of claim 3, wherein the first and second portions are adjacent one another.

5. The apparatus of claim 4, further comprising a stop located between the first portion and the main section and configured to restrain the ring from sliding from the first portion onto the main section.

6. The apparatus of claim 2, further comprising a fishing head attached to the main section.

7. The apparatus of claim 1, further comprising a sealing member disposed around the dart and configured to sealingly engage the valve assembly located in the wellbore completion.

8. The apparatus of claim 1, wherein the ring comprises:

first and second ends spaced circumferentially apart by a gap; and a rib disposed in the gap and engaging the first and second ends.

9. The apparatus of claim 8, wherein the rib is elastically deformable and configured to expand when the variable diameter of the ring increases and to contract when the variable diameter of the ring decreases.

10. A method for plugging a wellbore completion, comprising:

deploying a dart into the wellbore completion past a first valve assembly;

catching the dart by engaging a ring disposed on the dart with a second valve assembly to plug the wellbore completion;

reducing a diameter of the first valve assembly from an initial diameter that is larger than a ring diameter of the ring, to a reduced diameter that is smaller than the ring diameter;

drawing the dart away from the second valve assembly and toward the first valve assembly;

engaging the ring with the first valve assembly having the reduced diameter; and moving the ring into a recessed section of the dart to reduce the ring diameter such that the ring diameter is less than the reduced diameter of the first valve assembly.

11. The method of claim 10, wherein catching the dart with the second valve assembly comprises holding the ring in position with a first stop disposed on the dart.

12. The method of claim 10, wherein moving the ring into the recessed section comprises:

sliding the ring into the recessed section; and deforming the ring to conform with a recessed diameter of the recessed section.

13. The method of claim 12, wherein deforming the ring comprises:

drawing two circumferential ends of the ring together; and contracting a deformable rib attached to the two circumferential ends.

14. The method of claim 10, wherein catching the dart comprises sealing the dart and the second valve assembly together with a seal member attached to the dart.

15. The method of claim 10, wherein the dart is a first dart and the method further comprises catching a second dart with the first valve assembly having the reduced diameter to plug the wellbore completion between a surface and the second valve assembly.

16. An apparatus for plugging a wellbore completion, comprising:

a valve assembly disposed within the wellbore and having an inner diameter that is variable between a first inner diameter and a second inner diameter;

a dart for being placed into the wellbore, wherein the dart comprises:

a main section having a main diameter;

a first recessed portion having a first recessed diameter that is less than the main diameter; and a second recessed portion having a second recessed diameter that is less than the first recessed diameter; and a dart ring disposed around the dart slideable between the first and second recessed portions, wherein an outer diameter of the dart ring is less than the first inner diameter of the valve assembly when the dart ring is disposed around the first recessed portion such that the dart is able to pass through the valve assembly, wherein the outer diameter of the dart ring is greater than the second inner diameter of the valve assembly when the dart ring is disposed around the first recessed portion such that the dart ring is configured to engage the valve assembly, and wherein the outer diameter of the dart ring is less than the second inner diameter of the valve assembly when the dart ring is disposed around the second recessed portion such that the dart is able to pass through the valve assembly.

17. The apparatus of claim 16, wherein the valve assembly further comprises a valve ring, and wherein the outer diameter of the dart ring is sized to engage the valve ring to plug the wellbore completion when the dart ring is disposed around the first recessed portion.

18. The apparatus of claim 16, wherein:

the first recessed portion is located directly adjacent the second recessed portion; and the dart further comprises a first stop located adjacent the first recessed portion, a second stop located adjacent the second portion, the first and second stops being configured to restrict the dart ring from sliding onto the main section.

19. The apparatus of claim 16, wherein the dart ring comprises:

first and second ends spaced circumferentially apart by a gap; and a rib disposed in the gap and engaging the first and second ends, the rib being elastically deformable and configured to expand when the adjustable diameter of the dart ring increases and to contract when the adjustable diameter decreases.

20. An apparatus for plugging a wellbore completion, comprising:

a body comprising:

a main section having a main diameter;

a first recessed portion having a first recessed diameter that is less than the main diameter; and a second recessed portion having a second recessed diameter that is less than the first recessed diameter; and a dart ring disposed around the body, having an adjustable diameter, and configured to slide between the first and second recessed portions such that an inner diameter of the dart ring conforms to the first recessed diameter when the dart ring is located on the first recessed portion and the inner diameter conforms to the second recessed diameter when the dart ring is located on the second recessed portion;

a first valve ring, wherein an outer diameter of the dart ring is sized to engage the first valve ring to plug the wellbore completion when the dart ring is located on the first recessed portion; and a second valve ring, wherein the dart ring is further configured to engage the second valve ring when the dart ring is located on the first recessed portion, and to slide from the first recessed portion to the second recessed portion in response to the engagement with the second valve ring.

* * * * *